United States Patent [19]

Bar-on

[11] 3,935,836

[45] Feb. 3, 1976

[54] METERING BLADE FOR A FUSER ROLL

[75] Inventor: Ari Bar-on, Rochester, N.Y.

[73] Assignee: Xerox Corporation, Stamford, Conn.

[22] Filed: Jan. 13, 1975

[21] Appl. No.: 540,732

[52] U.S. Cl. ..... 118/60; 15/256.51; 118/202; 118/261

[51] Int. Cl.[2] ..... B05C 11/04

[58] Field of Search ..... 118/60, 70, 104, 123, 126, 118/202, 203, 261; 15/256.51; 432/60, 75

[56] References Cited

UNITED STATES PATENTS

| | | | |
|---|---|---|---|
| 1,803,927 | 5/1931 | Vedder | 15/256.51 |
| 2,396,946 | 3/1946 | Grupe | 118/202 |
| 3,122,767 | 3/1964 | Carvill | 118/70 |
| 3,335,701 | 8/1967 | Verkinderen et al. | 118/126 |
| 3,353,517 | 11/1967 | Tower | 118/261 |
| 3,377,644 | 4/1968 | Budzinski et al. | 15/256.51 |
| 3,735,733 | 5/1973 | Henc | 118/261 |
| 3,795,221 | 3/1974 | Michael | 118/261 |
| 3,800,702 | 4/1974 | Roberts | 15/256.51 |
| 3,811,821 | 5/1974 | Ariyama et al. | 118/60 |
| 3,883,291 | 5/1975 | Cloutier et al. | 118/60 |

*Primary Examiner*—Mervin Stein
*Assistant Examiner*—Douglas Salser
*Attorney, Agent, or Firm*—H. Fleischer; J. J. Ralabate; C. A. Green

[57] ABSTRACT

An apparatus in which the quantity of release material metered to a heated fuser member is regulated. The apparatus includes a blade positioned in contact with the fuser member to remove excessive release material therefrom.

10 Claims, 3 Drawing Figures

METERING BLADE FOR A FUSER ROLL

BACKGROUND OF THE INVENTION

This invention relates generally to an electrostatographic printing machine and more particularly concerns an apparatus for controlling the quantity of release material metered to a heated fuser member.

In a typical electrostatographic printing machine, a latent image is recorded on a surface and developed with charged particles. The particles are transferred from the image bearing surface to a sheet of support material. Thereafter, the particles are permanently affixed to the sheet of support material forming a copy of the original document. Electrostatographic printing includes electrophotographic printing and electrographic printing. Both of the foregoing processes are similar to one another. Electrophotographic printing employs a photoconductive member which is charged to a substantially uniform level. A light image of the original document irradiates the charged photoconductive member dissipating the charge in the irradiated areas recording an electrostatic latent image thereon. Electrographic printing differs from electrophotographic printing in that a photoconductive member or a light image is not required to create a latent image of the original document. Generally, both of the foregoing processes employ heat settable particles which are permanently affixed to the sheet of support material by the application of heat thereto.

In order to permanently affix the particles to the sheet of support material, it is necessary to elevate or heat the particles to a point at which the constituents thereof coalesce and become tacky. This action causes the particles to be absorbed to some degree into the fibers of the sheet of support material which may be amongst others, plain paper or a sheet of thermoplastic material. After the particles cool, solidification of the particles produces a firm bond between the sheet of support material and the particles. The use of heat to permanently affix powder images onto a sheet of support material is well known in the art.

One approach for applying heat thereto is to pass a sheet of support material with the powder image thereon through a pair of opposed rollers at least one of which is heated. One type of system employing a pair of rollers utilizes a heated fuser roller having an outer surface covered with polytetrafluoroethylene, commonly known as Teflon, to which a release agent, such as silicone oil is applied. Preferably, the Teflon layer has a thickness of about several mils with the thickness of the oil being less than one micron. Silicone based oils, which possess a relatively low surface energy, have been found to be useful for heated fuser rolls having an outer surface of Teflon. Generally, a thin layer of silicone oil is applied to the surface of the heated roller to form an interface between the roll surface and powder image carried on the support material. The low surface energy of this layer prevents the particles from transferring to the roller. This insures that the particles remain on the sheet of support material so as to be permanently affixed thereto during the heating process.

Another approach has been to employ a metal heated roller which has a low molecular weight polyethylene applied thereto as a release agent. This release material is generally a solid at room temperature. Hereinbefore, it has been difficult to control or regulate the quantity of release material applied to the fuser roll. One approach taken is described in co-pending application Ser. No. 482,675 filed in 1974. As described therein, a composite doctor blade structure engages the fuser roll to meter a prescribed thickness of release material thereto. The doctor blade assembly is loosely supported enabling it to expand freely under temperature.

It is a primary object of the present invention to improve the structure employed to control the metering of release material to a heated fuser member.

SUMMARY OF THE INVENTION

Briefly stated, and in accordance with the present invention, there is provided an apparatus for regulating the quantity of release material metered to a heated fuser member. The heated fuser member is operatively associated with a backup member with a sheet of support material being interposed therebetween. As the sheet of support material passes between the backup member and fuser member, the particles adhering thereto contact the fuser member.

Pursuant to the features of the present invention, means are provided for applying the release material to the fuser member. A flexible blade has one end portion thereof contacting the fuser member to adjust the thickness of the layer of release material applied thereto. Biasing means resiliently urge the blade into contact with the fuser member. A clamping plate is secured to a support member with the other end portion of the blade being interposed therebetween. In this manner, the blade is supported in cantilever fashion.

BRIEF DESCRIPTION OF THE DRAWINGS

Other objects and advantages of the present invention will become apparent upon reading the following detailed description and upon reference to the drawings, in which.

While the present invention will hereinafter be described in connection with the preferred embodiment thereof, it will be understood that it is not intended to limit the invention to that embodiment. On the contrary, it is intended to cover all alternatives, modifications and equivalents as may be included within the spirit and scope of the invention as defined by appended claims.

DETAILED DESCRIPTION OF THE INVENTION

Figure 1:
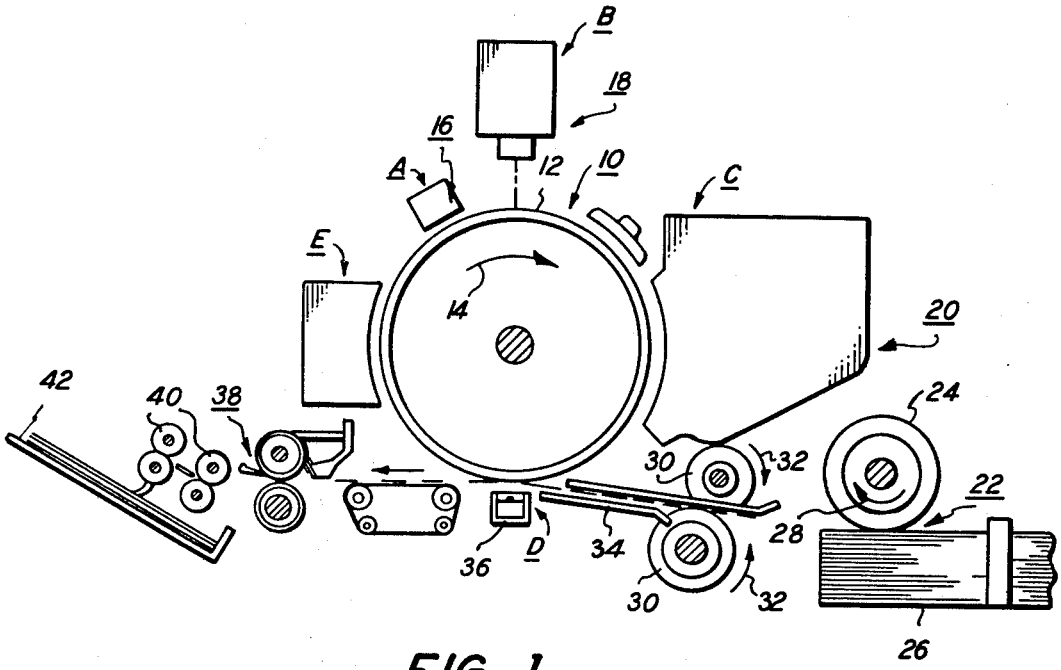
FIG. 1 is a schematic elevational view illustrating an electrophotographic printing machine incorporating the features of the present invention therein.

For a general understanding of an electrophotographic printing machine in which the present invention may be incorporated, reference is had to FIG. 1 which depicts schematically the various components thereof. Hereinafter, like reference numerals will be employed throughout to designate like elements. Although the apparatus for metering the release agent to a fusing member employed in the electrophotographic printing machine of FIG. 1, is particularly well adapted for use therein, it should become evident from the following discussion that it is equally well suited for use in a wide variety of devices and is not necessarily limited in its application to the particular embodiment shown herein.

Since the practice of electrophotographic printing is well known in the art, the various processing stations for producing a copy of an original document are herein represented in FIG. 1 as blocks A through E, inclusive. Each of these blocks will be briefly discussed hereinafter.

As in all electrophotographic systems of the type illustrated, a drum 10 having a photoconductive surface 12 entrained about and secured to the exterior circumferential surface thereof is rotated, in the direction of arrow 14, through the various processing stations. One type of suitable photoconductive material is described in U.S. Pat. No. 2,970,906 issued to Bixby in 1961.

Initially, drum 10 rotates photoconductive surface 12 through charging station A. Charging station A employs a corona generating device, indicated generally at 16, to sensitize photoconductive surface 12. Corona generating device 16 is positioned closely adjacent to photoconductive surface 12. When energized, corona generator device 16 charges photoconductive surface 12 to a relatively high substantially uniform potential. For example, corona generating device 16 may be of the type described in U.S. Pat. No. 2,836,725 issued to Vyverberg in 1958.

Thereafter, drum 10 rotates the charged photoconductive surface 12 to exposure station B. Exposure station B includes a stationary, transparent platen member, such as a glass plate or the like, for supporting an original document thereon. Lamps illuminate the original document. Scanning of the original document may be achieved by oscillating a mirror in a timed relationship with a movement of drum 10. This mirror is positioned beneath the platen and adapted to reflect the light image of the original document through a lens onto a mirror which, in turn, transmits the light image through an apertured slit onto charged photoconductive surface 12. Irradiating the charged photoconductive surface 12 records an electrostatic latent image thereon corresponding to the original document.

Drum 10 rotates the electrostatic latent image to development station C. Development station C includes a developer unit 20 having a housing with a supply of developer mix therein. The developer mix comprises carrier granules and toner particles adhering thereto. The carrier granules are formed from a magnetic material with the toner particles being formed from a heat settable plastic. Preferably, developer unit 20 is a magnetic brush development system. In such a system, the developer mix is brought through a directional flux field to form a brush thereof. The electrostatic latent image recorded on photoconductive surface 12 is developed by bringing the brush of developer mix into contact therewith. In this manner, the toner particles are attracted electrostatically to the latent image for forming a toner powder image on photoconductive surface 12.

With continued reference to FIG. 1, a sheet of support material is advanced by sheet feeding apparatus 22 to transfer station D. Sheet feeding apparatus 22 includes a feed roll 24 contacting the uppermost surface of the stack of sheets of support material 26. Feed roll 24 rotates in the direction of arrow 28 so as to advance the uppermost sheet from stack 26. Registration rollers 30 rotating in the direction of arrow 32, align and forward the advancing sheet of support material into chute 34. Chute 34 directs the advancing sheet of support material into contact with drum 10 in a timed sequence so that the toner powder image developed thereon contacts the advancing sheet of support material at transfer station D.

At transfer station D, corona generating device 36 applies a spray of ions to the back side of the sheet of support material. This attracts the toner powder image from photoconductive surface 12 to the sheet of support material.

After transfer of the toner powder image to the sheet of support material, the sheet of support material is advanced to a suitable fuser assembly, indicated generally by the reference numeral 38. Fuser assembly 38 fuses the transferred toner powder image to the sheet of support material. After the fusing process, the sheet of support material is advanced by a series of rolls 40 to catch tray 42 for subsequent removal therefrom by the machine operator. Fuser assembly 38 will be discussed hereinafter with reference to FIG. 2.

Invariably, after the sheet of support material is separated from photoconductive surface 12, some residual toner particles adhere thereto. These residual toner particles are removed from photoconductive surface 12 at cleaning station E. Initially, toner particles are brought under the influence of a corona generating device adapted to neutralize the remaining electrostatic charge on photoconductive surface 12 and that of the residual toner particles. The neutralized toner particles are cleaned from photoconductive surface 12 by a rotatably mounted fibrous brush in contact therewith. Subsequent to cleaning, a discharge lamp floods photoconductive surface 12 with light to dissipate any residual electrostatic charge remaining thereon prior to the charging thereof for the next successive cycle.

Figure 2:
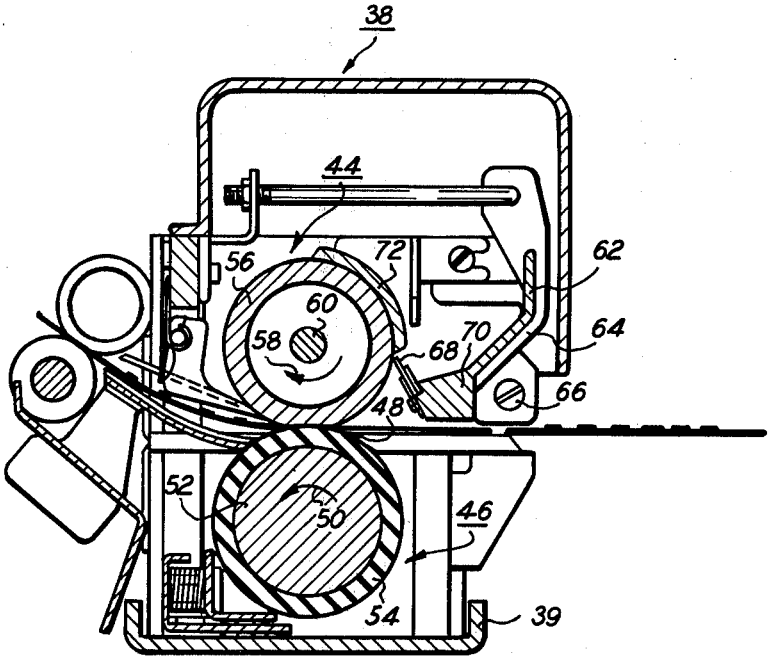
FIG. 2 is a sectional elevational view showing the FIG. 1 printing machine fuser assembly.

It is believed that the foregoing description is sufficient for purposes of the present application to illustrate the general operation of an electrophotographic printing machine. Referring now to the specific subject matter of the present invention, FIG. 2 depicts fuser assembly 38 in greater detail.

Fuser assembly 38 comprises a heated fuser roll, indicated generally by the reference numeral 44, and a backup roll, indicated generally by the reference numeral 46. Fuser roll 44 cooperates with backup roll 46 to form a nip 48 therebetween through which a sheet of support material having a toner powder image thereon passes with the toner powder image contacting fuser roll 44.

A channel shaped base 39 is provided for supporting fuser assembly 38 in the electrophotographic printing machine shown in FIG. 1. Backup roll 46 is mounted rotatably on a pair of brackets (not shown) secured to the channel shaped base by means of a right angle bracket. As shown, backup roll 46 is adapted to rotate in the direction of arrow 50. Preferably, backup roll 46 includes a rigid steel core or shaft 52 having a Viton elastomeric surface or layer 54 disposed thereover and affixed thereto. Shaft 52 is secured rotatably on brackets by a pair of bearings held in place by retaining rings. By way of example, backup roll 46 has an overall dimension of approximately 1.55 inches with a 0.1 inch cover or layer of Viton or other suitable high temperature elastomeric material, for example fluorosilicone or silicone rubber. Backup roll 46 is preferably 15 ½ inches long to accomodate various width sizes of support material.

A pair of brackets having a generally E-shaped configuration are provided for mounting fuser roll 44 rotatably in fuser assembly 38. To this end, a pair of ball bearings one in each of the support brackets are provided. The bearings are retained in the brackets by means of retaining rings. A pair of end caps are secured to hollow cylinder or core 56 forming a part of fuser roll 44. The end caps have reduced end portions so as to be mounted in the bearings permitting fuser roll 44 to rotate in the direction of arrow 58. A heating element 60 is supported internally of core 56 for provided thermal energy to heat core 56 to the operating temperature thereof. Heating element 60 may comprise any suitable type heater for elevating the surface temperature of core 56 to operational temperatures, i.e., 285°F to 295°F. By way of example, heating element 60 may include quartz envelope having a tungsten resistance heating element disposed herein. Preferably, cylinder 56 is fabricated from any suitable material capable of efficiently conducting the heat to the external surface thereof. For example, suitable materials are anodized aluminum and alloys thereof, steel, stainless steel, nickel and alloys thereof, nickel plated copper, chromium plated copper, copper and alloys thereof. The resultant fuser roll 44 has an outside diameter preferably of about 1.5 inches with the length thereof about equal to that of backup roll 46. In operation, fuser roll 44 requires about 420 watts peak power with the average power being about 320 watts, and about 100 watts being provided for standby operation.

Heating element 60 is supported internally of cylinder 56 by a pair of spring supports which are mounted in insulator blocks secured to support brackets. The free ends of the spring supporting the heating elements are provided with a locating ball while the opposite end of the spring is disposed in contact with an electrical terminal to which electrical wires may be attached for applying electrical energy to heating element 60. The insulator blocks can be secured to support brackets in any suitable manner, for example by screws. The spring supports and terminals are preferably riveted to the insulating block.

The aforementioned materials from which cylinder 56 or 44 is fabricated are relatively high surface energy materials. Thus, hot toner material contacting such surfaces would readily wet the surface of cylinder 56. The toner wetting the surface of cylinder 56 is difficult to remove therefrom. Accordingly, there is provided a housing 62 for containing a material capable of interacting with the cylinder 56 in a manner described in co-pending application Ser. No. 383,231 filed in 1973. The material is, preferably, a low molecular weight substance which is a solid at room temperature and has a relatively low viscosity at the operating temperature of cylinder 56. An example of such a material is a polyethylene manufactured by Allied Chemical company and having the designation AC-8 homopolymer. Housing 62 has a rear wall 64 having a generally sloping portion connected to a generally vertical portion. Rear wall 64 is provided with a pair of apertured flanges 66 for receiving supports therein to mount housing 62 pivotably in fuser assembly 38. The polyethylene contained in housing 62 is a solid at room temperature and a liquid at operational temperatures. Polyethylene, in solid form, is placed in housing 62 and heated by the thermal energy of fuser roll 44 to its liquid temperature. When the polyethylene resolidifies after the machine has been inoperative for a period of time, the polyethylene tends to move away from the fuser roll 44. Thus, the polyethylene may not be immediately applied to fuser roll 44 at the initiation of the machine cycle. In order to prevent the foregoing, a collecting bar is provided in the sump adjacent to fuser roll 44 and the surface of the rear wall of sump 62 is coated with a material that has a low affinity for the polyethylene, i.e., silicone rubber. Thus, the liquid polyethylene solidifies on the collecting bar adjacent to the fuser roll 44 and will be in contact therewith at the initiation of the next successive machine cycle.

Housing 62 comprises a front wall which has a flexible blade 68 secured to a support member 70. The detailed structural configuration thereof will be described with reference to FIG. 3. Preferably, housing 62 is pivoted to increase or decrease the pressure of blade 68 on cylinder 56 of fuser roll 44. This controls the thickness of the layer of polyethylene deposited thereon. By way of example, a layer less than one micron thick is preferably applied thereto. It should be noted that in addition to serving as a metering blade, blade 68 serves to clean toner from fuser roll 44 and also acts as a seal to prevent the leakage of liquid, low viscosity polyethylene from housing 62. A pair of end seals 72 contact fuser roll 44 to prevent side leakage of the polyethylene from housing 62. Seals 72 are mounted in recesses contained within housing 62 and cooperate with blade 68 to prevent leakage of polyethylene therefrom. By way of example, end seals 72 may be a closed cell silicone sponge rubber material affixed to housing 62 and engaging cylinder 56 of fuser roll 44 to prevent leakage of the polyethylene material therefrom. The foregoing structural arrangement is described in greater detail in co-pending application Ser. No. 482,675 filed in 1974, the relevant portions thereof being hereby incorporated into the present application.

Figure 3:
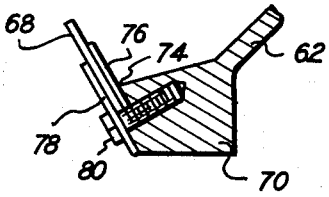
FIG. 3 is an enlarged, fragmentary, sectional elevational view depicting the metering blade employed in the FIG. 2 fuser assembly.

Referring now to FIG. 3, the apparatus for regulating the quantity of release material or polyethylene deposited on the fuser roll 44, will be described hereinafter in greater detail. Housing 62 includes support member 70 having blade 68 secured thereto. Support member 70 has a recess therein permitting seal 74 to be disposed therein. This prevents the leakage of the liquid polyethylene or release material from housing 62 at the joint between blade 68 and support member 70. Preferably, seal 74 is fabricated from a closed cell silicone sponge rubber material. Blade 68 is mounted in a cantilever fashion to support member 70. The free end of blade 68 contacts cylinder 56 of fuser roll 44. The pressure between cylinder 56 and blade 68 determines the thickness or quantity of release material deposited thereon. Blade 68, preferably, is fabricated from a high temperature elastomeric material such as silicone rubber or Viton. The other end of blade 68 is secured to supporting member 70. Interposed between blade 68 and support member 70 is leaf spring 76. Leaf spring 76 is also mounted in cantilever fashion on support member 70. Leaf spring 76 has one surface thereof contacting the surface of blade 68 opposed from fuser roll 44. Thus, leaf spring 76 and blade 68 are mounted in juxtaposition with one another. Spring 76 extends parallel to blade 68 a distance less than blade 68. This insures that only blade 68 contacts fuser roll 44. Preferably, spring 76 is made from a suitable spring steel or brass. Clamping plate 78 secures both blade 68 and spring 76 to supporting member 70. Plate 78 extends across blade 68 and is in contact therewith. A suitable fastener such as a plurality of screws secure plate 78 to support 70 with blade 68 and leaf spring 76 interposed therebetween. However, the fasteners do not pass through blade 68 or spring 76, but are spaced therefrom. Preferably, clamping plate 78 is made from a suitable stainless steel material. Clamping plate 78 is made from a material having a thermal co-efficient of expansion that is less than the thermal co-efficient of expansion of blade 68. By securing blade 68 in the manner illustrated, blade 68 expands laterally inasmuch as no restraints are applied thereto. In this way, blade 68 does not corregate or buckle when the temperatures in the surrounding environment change. The foregoing characteristics are achieved by not applying any restraints to blade 68. Once again, a plurality of fasteners 80 secure clamping plate 78 to support member 70 with blade 68 and spring 76 interposed therebetween, but spaced from the fasteners. Spring 76 compresses seal 74 to prevent the leakage of liquid polyethylene between supporting member 70 and spring 76.

In recapitulation, it is apparent that pursuant to the features of the present invention, as heretofore described the apparatus meters the quantity of release material deposited on the fuser roll so as to prevent the adhesion of toner particles thereto during the fusing process. The foregoing is achieved by an elastomeric blade secured in cantilever fashion to a support and resiliently biased into engagement with the fuser roll by a leaf spring. A clamping plate secures the blade to the support in an unrestrained manner. This type of support arrangement prevents thermal variations from inducing buckles or corregations in the blade member.

It is, therefore, evident that there has been provided, in accordance with the present invention, an apparatus for regulating the quantity of release material deposited on a fuser roll in an electrophotographic printing machine. The apparatus of the present invention fully satisfies the objects, aims and advantages hereinbefore set forth. While this invention has been described in conjunction with specific embodiments thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for regulating the quantity of release material metered to a heated fuser member operatively associated with a backup member wherein a sheet of support material having particles thereon passes therebetween with the particles contacting the fuser member, including:

means for applying the release material to the surface of the fuser member;

a support member;

a flexible blade member having one end portion thereof contacting the fuser member for adjusting the thickness of release material applied thereto;

biasing means for resiliently urging said blade member to contact the fuser member so as to remove excessive release material from the surface thereof; and a clamping plate secured to said support member with the other end portion of said blade member being interposed between said support member and said plate to secure said plate in cantilever fashion to said support member.

2. An apparatus as recited in claim 1, wherein said applying means includes a housing for storing a supply of release material therein, said blade member forming one wall of said housing.

3. An apparatus as recited in claim 2, further including a resilient member interposed between a portion of said other end portion of said blade member and said support member interiorly of said housing to prevent leakage of the release material therefrom.

4. An apparatus as recited in claim 3, wherein:

said blade member includes an elastomeric material; and said clamping plate includes a stainless steel material.

5. An apparatus as recited in claim 3, wherein said biasing means includes a leaf spring having one end portion thereof interposed between said support member and said blade member with one surface of said leaf spring in juxtaposition with the surface of said blade member opposed from the fuser member and extending from said support member a distance less than said blade member.

6. A fusing apparatus employed in an electrostatographic printing machine for permanently affixing toner particles to a sheet of support material, including:

a heated fuser roll;

a backup roll operatively associated with said fuser roll to enable the sheet of support material to pass therebetween with the toner particles thereon contacting said fuser roll;

means for applying a release material to the surface of said fuser roll; and means for regulating the quantity of release material metered to said fuser roll, said regulating means comprising a support member, a flexible blade having one end portion thereof contacting said fuser roll for adjusting the thickness of release material applied thereto, biasing means for resiliently urging the blade to contact said fuser roll to remove excessive release material from the surface thereof, and a clamping plate secured to the support member with the other end portion of the blade being interposed between the support member and the plate to secure the blade in cantilever fashion to the support member.

7. An apparatus as recited in claim 6, wherein said applying means includes a housing for storing a supply of release material therein, the blade of said regulating means forming one wall of said housing.

8. A fusing apparatus as recited in claim 7, further including a resilient member interposed between a portion of the other end portion of the blade and the support member of said regulating means interiorly of said housing to prevent leakage of the release material therefrom.

9. A fusing apparatus as recited in claim 8, wherein:

the blade of said regulating means includes an elastomeric material; and the clamping plate of said regulating means includes a stainless steel material.

10. A fusing apparatus as recited in claim 8, wherein the biasing means of said regulating means includes a leaf spring having one end portion thereof interposed between the support member and the blade with one surface of the leaf spring in juxtaposition with the surface of the blade opposed from said fuser roll and extending from the support member a distance less than the blade.

* * * * *